US009661923B2

(12) United States Patent
Lanphear

(10) Patent No.: US 9,661,923 B2
(45) Date of Patent: May 30, 2017

(54) TABLE AND ACCESSORY UNIT ASSEMBLY AND METHOD OF DOCKING ACCESSORY UNIT TO TABLE

(71) Applicant: John Stephen Lanphear, Lawrence, MI (US)

(72) Inventor: John Stephen Lanphear, Lawrence, MI (US)

( * ) Notice: Subject to any disclaimer, the term of this patent is extended or adjusted under 35 U.S.C. 154(b) by 0 days.

(21) Appl. No.: 14/587,348

(22) Filed: Dec. 31, 2014

(65) Prior Publication Data

US 2015/0182022 A1 Jul. 2, 2015

Related U.S. Application Data

(60) Provisional application No. 61/922,570, filed on Dec. 31, 2013.

(51) Int. Cl.

| | |
|---|---|
| ***A47B 7/00*** | (2006.01) |
| ***A47B 83/04*** | (2006.01) |
| *A47B 9/00* | (2006.01) |
| *A47B 31/00* | (2006.01) |

(52) U.S. Cl.

CPC ..... *A47B 83/04* (2013.01); *A47B 9/00* (2013.01); *A47B 31/00* (2013.01); *A47B 2200/0069* (2013.01)

(58) Field of Classification Search

CPC .. A47B 9/083; A47B 9/20; A47B 9/12; A47B 83/04; A47B 9/00; A47B 31/00; A47B 2200/0069

USPC ..... 108/64, 97, 180

See application file for complete search history.

(56) References Cited

U.S. PATENT DOCUMENTS

| | | | | |
|---|---|---|---|---|
| 1,750,129 A * | 3/1930 | Romine | B60P 3/08 280/1 |
| 1,750,131 A * | 3/1930 | Romine | B60P 3/08 280/1 |
| 3,122,244 A * | 2/1964 | Corso | B25B 11/00 104/34 |
| 4,023,771 A * | 5/1977 | Walchek | B28B 21/76 249/139 |

(Continued)

FOREIGN PATENT DOCUMENTS

EP 0278291 1/1988

OTHER PUBLICATIONS

"RDM—WorkBench I-107P-BOOM." *RDM—WorkBench I-107P-Boom*. N.p., Oct. 13, 2013. Web Nov. 25, 2014. http://www.rdm-ind.com/b-i107p-boom.htm.

*Primary Examiner* — Hanh V Tran
(74) *Attorney, Agent, or Firm* — Diederiks & Whitelaw, PLC

(57) ABSTRACT

A table and accessory unit assembly includes a height-adjustable table, a freestanding accessory unit and a docking mechanism. The height-adjustable table and freestanding accessory unit are supported on a surface. The height-adjustable table includes a tabletop and a height-adjusting mechanism that is configured to move the tabletop relative to the surface. The docking mechanism is configured to couple the freestanding accessory unit to the height-adjustable table. When the freestanding accessory unit is coupled to the height-adjustable table, the freestanding accessory unit moves relative to the surface as the tabletop moves relative to the surface.

21 Claims, 6 Drawing Sheets

(56) References Cited

U.S. PATENT DOCUMENTS

| | | | | | |
|---|---|---|---|---|---|
| 4,986,555 | A * | 1/1991 | Andreen | A47L 13/10 | 280/47.35 |
| 5,072,960 | A * | 12/1991 | Sperko | B62B 3/04 | 16/35 D |
| 5,553,986 | A * | 9/1996 | Napierkowski | B62B 5/04 | 104/251 |
| 5,913,528 | A * | 6/1999 | Kresse | B62B 3/02 | 280/416.3 |
| 6,073,942 | A * | 6/2000 | Heneveld, Sr. | B62B 5/00 | 280/33.991 |
| 6,213,481 | B1 * | 4/2001 | Marchese | A61G 12/001 | 248/282.1 |
| 6,260,643 | B1 * | 7/2001 | Schuchardt | B62B 3/1404 | 180/14.1 |
| 6,343,556 | B1 | 2/2002 | Lanphear | | |
| 6,874,432 | B2 * | 4/2005 | Lanphear | A47B 9/10 | 108/147 |
| 7,065,812 | B2 * | 6/2006 | Newkirk | A61G 12/005 | 248/125.8 |
| 7,278,615 | B2 | 10/2007 | Schubert et al. | | |
| 7,398,738 | B2 | 7/2008 | Newhouse et al. | | |
| 7,798,502 | B2 | 9/2010 | Sukey et al. | | |
| 7,865,983 | B2 * | 1/2011 | Newkirk | A61G 7/05 | 5/503.1 |
| 7,884,735 | B2 * | 2/2011 | Newkirk | A61G 7/012 | 211/26 |
| 8,215,650 | B2 * | 7/2012 | Arceta | A61G 12/001 | 108/147.19 |
| 8,235,402 | B2 | 8/2012 | Knappe et al. | | |
| 8,894,086 | B2 | 11/2014 | Ekbote | | |
| 2005/0206107 | A1 | 9/2005 | Schubert et al. | | |
| 2007/0151490 | A1 * | 7/2007 | Pflaster | A47B 83/04 | 108/180 |

* cited by examiner

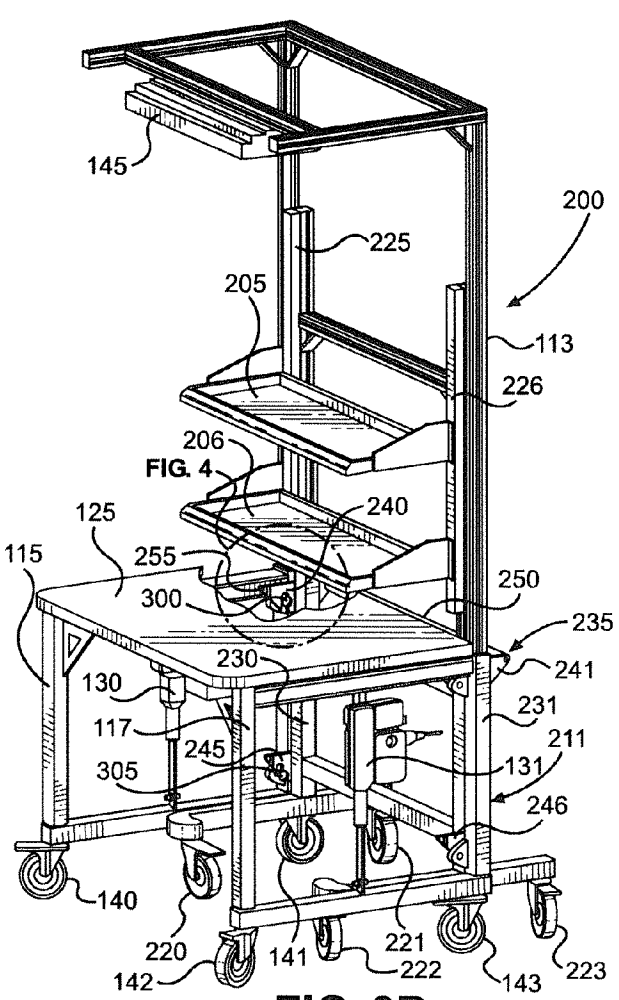
FIG. 4
FIG. 3B
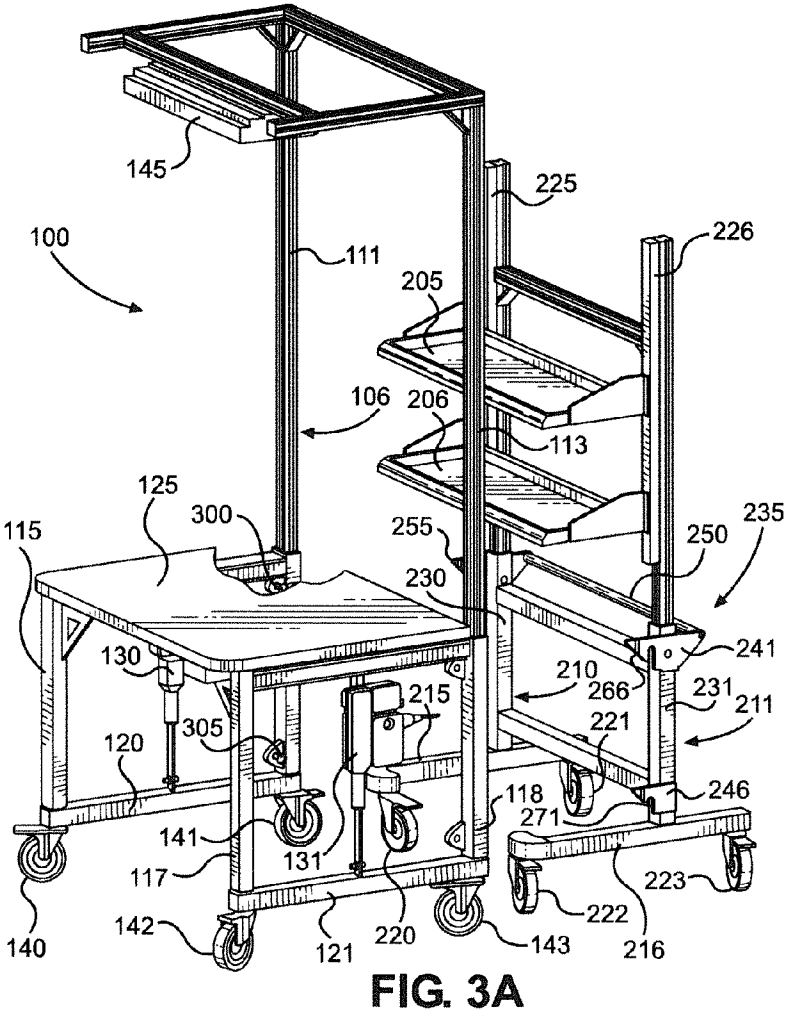
FIG. 3A

TABLE AND ACCESSORY UNIT ASSEMBLY AND METHOD OF DOCKING ACCESSORY UNIT TO TABLE

CROSS REFERENCE TO RELATED APPLICATIONS

This application claims the benefit of U.S. Provisional Patent Application Ser. No. 61/922,570, which was filed on Dec. 31, 2013 and titled "Rapid Change Technology Workstation and Trolley". The entire content of this application is incorporated by reference.

BACKGROUND OF THE INVENTION

The present invention pertains to adjustable-height tables and, more particularly, to docking mechanisms for such tables.

Portable, height-adjustable tables are used in a variety of fields. For example, such tables can be used in offices, restaurants, factories and machine shops. Exemplary tables are illustrated in U.S. Pat. Nos. 6,343,556 and 6,874,432, which are incorporated by reference. The portable nature of these tables allows them to be moved wherever they are needed. Additionally, by changing their height, the tables can be adapted to different tasks and users. However, this adjustability can also pose problems if the tables are used with non-height-adjustable structures, such as shelves or other tables. Therefore, there is a need in the art for a height-adjustable table that can be conveniently used with a non-height-adjustable structure.

SUMMARY OF THE INVENTION

The present invention is directed to a table and accessory unit assembly that includes a height-adjustable table, a freestanding accessory unit and a docking mechanism. The height-adjustable table and freestanding accessory unit are supported on a surface. The height-adjustable table includes a tabletop and a height-adjusting mechanism that is configured to move the tabletop relative to the surface. The docking mechanism is configured to couple the freestanding accessory unit to the height-adjustable table. When the freestanding accessory unit is coupled to the height-adjustable table, the freestanding accessory unit moves relative to the surface as the tabletop moves relative to the surface.

A first portion of the docking mechanism is located on the height-adjustable table while a second portion of the docking mechanism is located on the freestanding accessory unit. Preferably, the docking mechanism includes a pin and a latch, the latch contacting the pin when the freestanding accessory unit is coupled to the height-adjustable table. In one embodiment, the pin and latch constitute an upper pin and latch, and the docking mechanism also includes a lower pin and latch. The lower latch contacts the lower pin when the freestanding accessory unit is moved relative to the surface. Additionally, the upper latch is pivotally coupled to the height-adjustable table or freestanding accessory unit, while the lower latch is fixed to the height-adjustable table or freestanding accessory unit.

In another embodiment, the latch includes a cam surface and a slot. The cam surface is configured to contact the pin during coupling of the freestanding accessory unit to the height-adjustable table, and the slot is configured to receive the pin when the freestanding accessory unit is coupled to the height-adjustable table. Preferably, the docking mechanism further includes a handle configured to cause the latch to pivot relative to the pin. Also, the latch further includes an in-turned portion that can contact the height-adjustable table or freestanding accessory unit during coupling of the freestanding accessory unit to the height-adjustable table.

In yet another embodiment, the freestanding accessory unit includes a leg and a storage structure coupled to the leg. In addition, the freestanding accessory unit further includes a foot or caster configured to support the freestanding unit on the surface. The front, or leading, casters on the freestanding accessory unit are mounted offset to the inside of the freestanding accessory unit lower support members so as not to allow these casters to come into conflict with the lower support members of the height-adjustable table during docking and undocking of the freestanding accessory unit.

Additional objects, features and advantages of the present invention will become more readily apparent from the following detail description of preferred embodiments when taken in conjunction with the drawings wherein like reference numerals refer to corresponding parts in the several views.

BRIEF DESCRIPTION OF THE DRAWINGS

FIG. 3A is a perspective view of the table and accessory unit with a portion of the table cut away;

FIG. 3B is a perspective view of the table and accessory unit docked to one another at a first height;

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

Figure 1B:
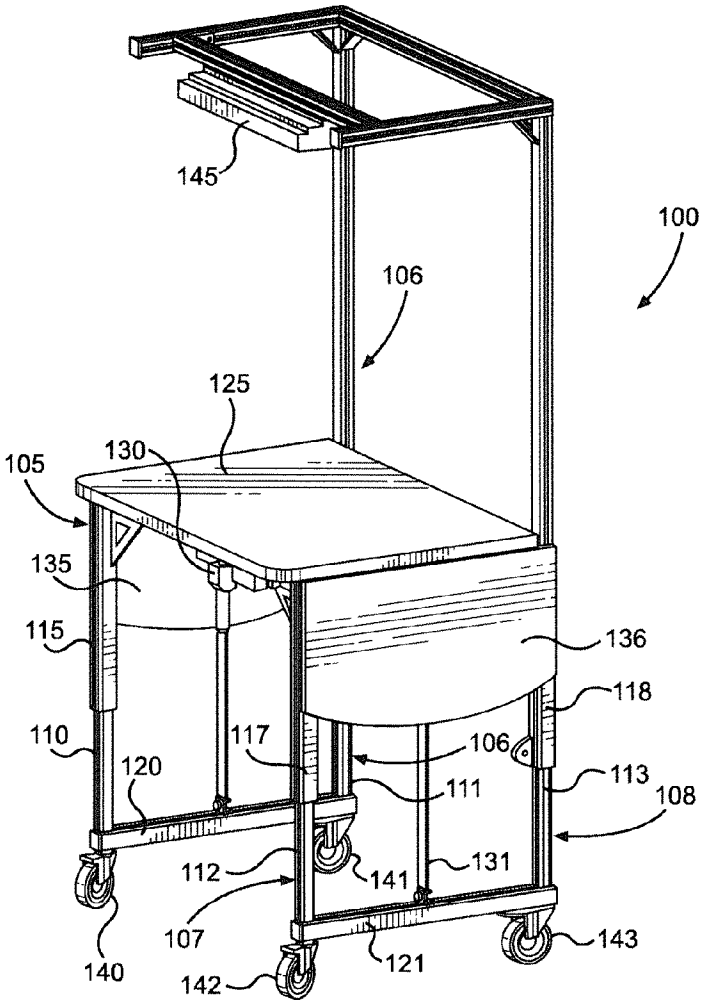
FIG. 1B is a perspective view of the table at a second height.
Figure 1A:
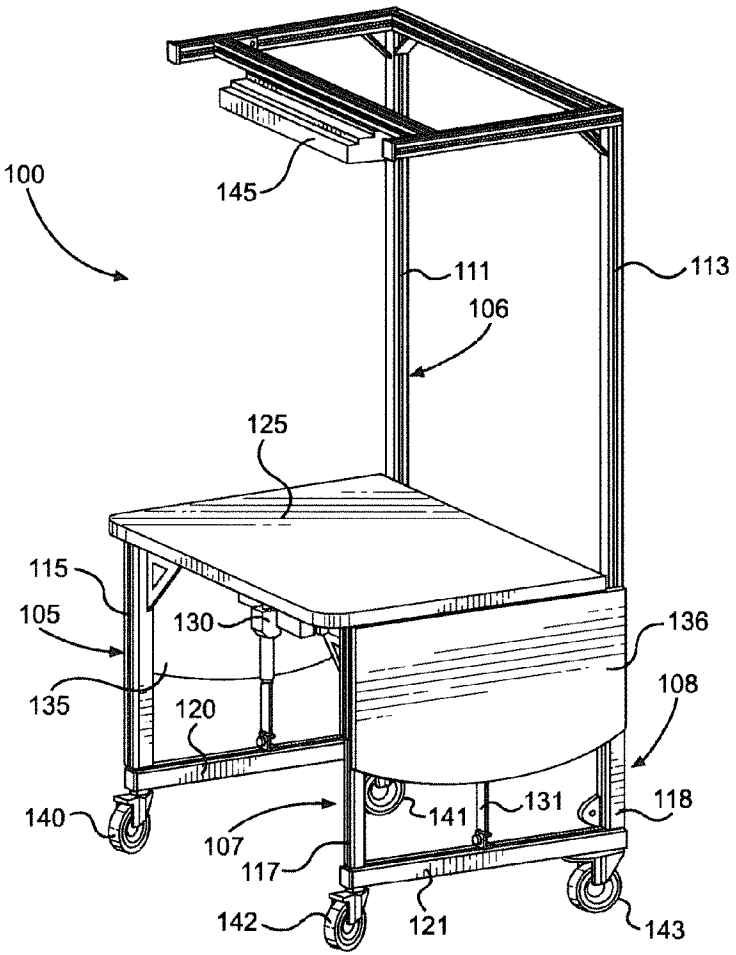
FIG. 1A is a perspective view of a height-adjustable table, constructed in accordance with the present invention, with the table located at a first height.

With initial reference to FIGS. 1A and 1B, there is illustrated a portable, height-adjustable table, or workstation, 100 constructed in accordance with the present invention. Table 100 includes four legs, or rails, 105-108, each of which has an inner leg 110-113 and a corresponding outer leg 115-118. Inner legs 110-113 are coupled to a lower unit including lower support members 120, 121, while outer legs 115-118 are coupled to an upper unit including a tabletop 125 and upper support members (which are not visible in FIGS. 1A and 1B). Outer legs 115-118 move relative to inner legs 110-113 so that tabletop 125 can be selectively positioned at different heights relative to the surface on which table 100 is supported. The movement of outer legs 115-118 relative to inner legs 110-113 is effected by left and right height-adjusting mechanisms 130, 131, which together define a height-adjusting mechanism. The height-adjusting mechanism preferably uses screw drives, although other types of linear actuators can also be used (e.g., hydraulic, pneumatic). Left and right height-adjusting mechanisms 130, 131 extend from lower support members 120, 121 to upper support members in order to shift tabletop 125, upper support members and outer legs 115-118 relative to inner legs 115-118 and lower support members 120, 121. FIGS. 1A and 1B show tabletop 125 at two different heights. However, tabletop 125 can of course be selectively positioned at any number of different heights, as desired by a user. As illustrated, table 100 also includes a number of optional features. For example, guards 135, 136 are provided to protect the height-adjusting mechanism from damage, while casters 140-143 allow table 100 to be easily moved from one location to another. In addition, a light source 145 provides light to tabletop 125 and the area around table 100.

Figure 2B:
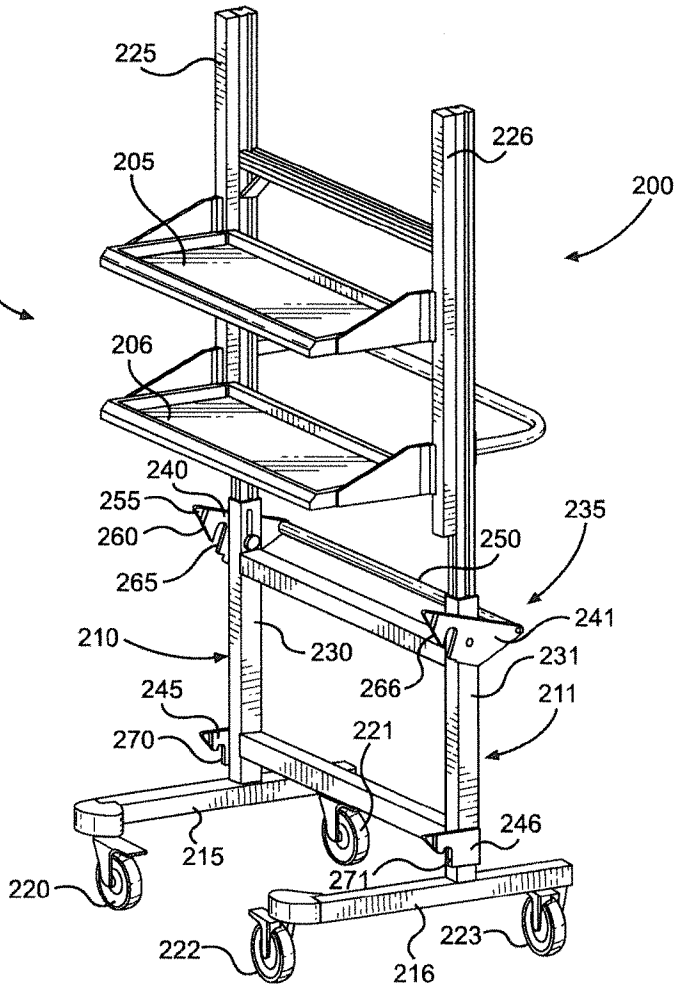
FIG. 2B is a perspective view of the accessory unit with a portion of a docking mechanism pivoted on the axis of the docking mechanism.
Figure 2A:
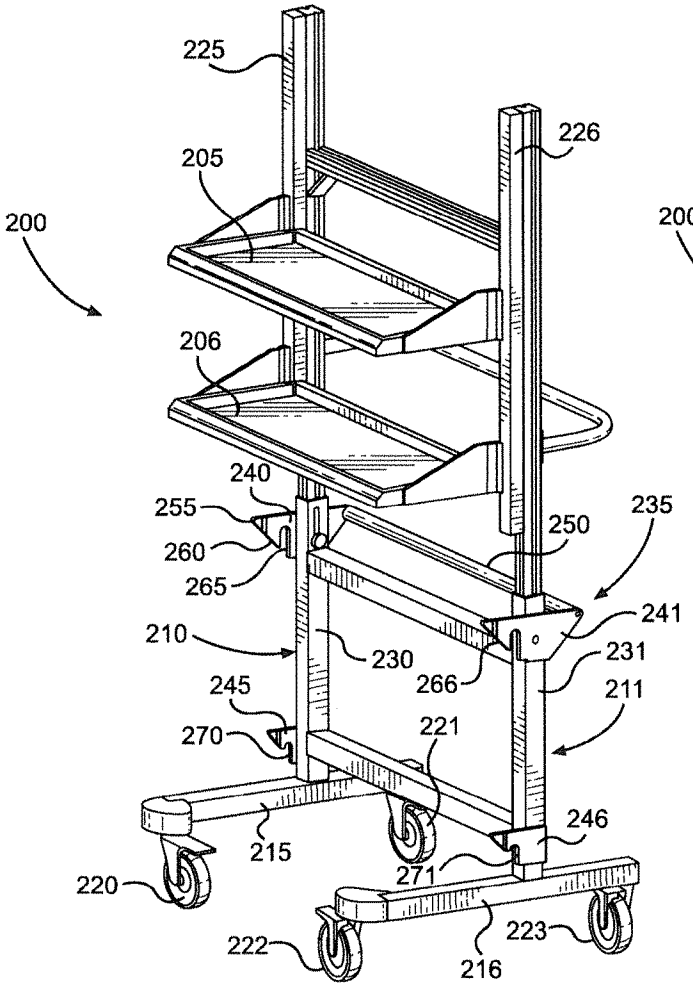
FIG. 2A is a perspective view of an accessory unit constructed in accordance with the present invention.

With reference now to FIGS. 2A and 2B, there is shown a freestanding accessory unit 200 constructed in accordance with the present invention. Accessory unit 200 can include one or more storage structures, such as bins, drawers or shelves, or accessory unit 200 can include other more specialized structure depending upon the field in which table 100 is used. In the present embodiment, accessory unit 200 is provided with shelves 205, 206. Accessory unit 200 also includes legs 210, 211, support members 215, 216 and casters 220-223. As with legs 105-108, legs 210, 211 have inner legs 225, 226 and outer legs 230, 231 so that the height of shelves 205, 206 can be adjusted relative to the surface on which accessory unit 200 is supported. In addition, a portion of a docking mechanism 235 is provided on accessory unit 200. Specifically, docking mechanism 235 includes upper latches 240, 241 and lower latches 245, 246. Upper latches 240, 241 are connected by a handle 250, which allows upper latches 240, 241 to be pivoted relative to accessory unit 200. Springs (not shown) cause upper latches 240, 241 to return to the position shown in FIG. 2A when handle 250 is released. Lower latches 245, 246 are fixed to legs 210, 211 and, therefore, do not pivot. Each of upper latches 240, 241 and lower latches 245, 246 includes an in-turned portion (one of which is labeled 255) and a cam surface (one of which is labeled 260), the functions of which are described below. Additionally, upper latches 240, 241 include slots 265, 266, while lower latches 245, 246 include slots 270, 271. Slots 265, 266, 270, 271 receive pins of table 100 in order to securely dock accessory unit 200 to table 100, as described more fully below.

Figure 3C:
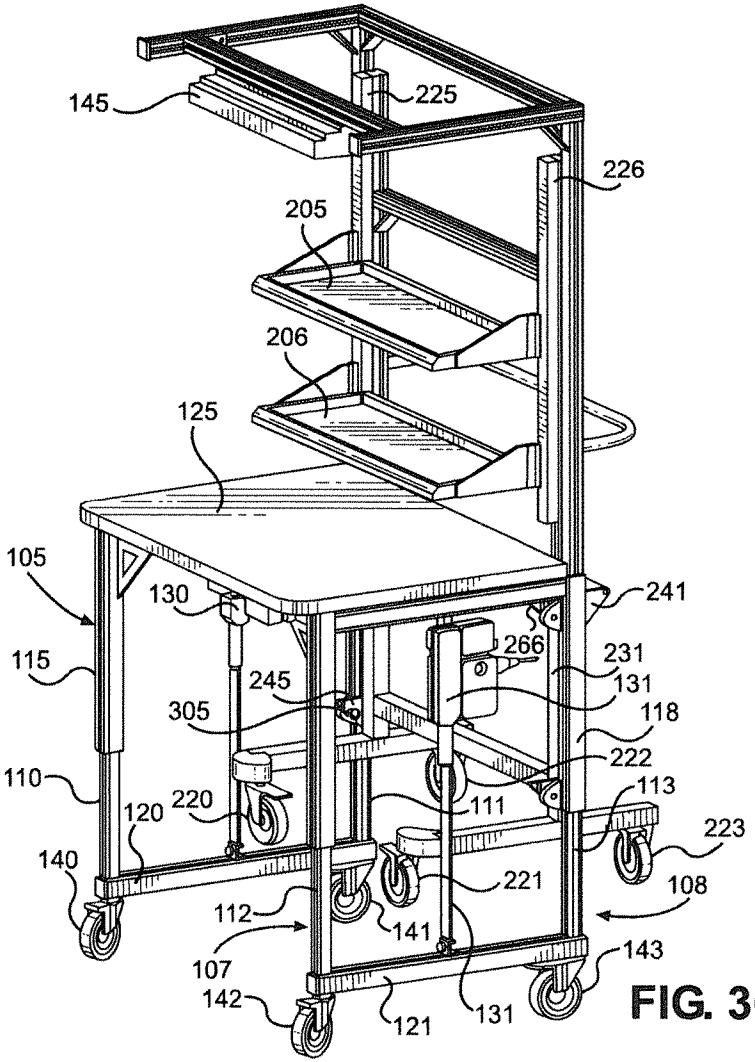
FIG. 3C is a perspective view of the table and accessory unit at a second height.

FIGS. 3A-C illustrate the docking of accessory unit 200 to table 100. A portion of tabletop 125 has been cut away so that an upper pin 300 is visible. Guards 135, 136 have also been removed such that a lower pin 305 and more of the height-adjusting mechanism can be seen. In addition to pins 300, 305, corresponding upper and lower pins are located on the opposite side of table 100, although these pins cannot be seen in this view. The four pins, together with upper latches 240, 241 and lower latches 245, 246, make up docking mechanism 235. During docking, as accessory unit 200 is moved towards table 100, the in-turned portions of upper latches 240, 241 and lower latches 245, 246 contact legs 106, 108 and thereby help align accessory unit 200 with table 100. Next, the cam surfaces of upper latches 240, 241 contact the upper pins, and upper latches 240, 241 are caused to pivot. Once accessory unit 200 is close enough to table 100, the upper pins enter slots 265, 266, which allows upper latches 240, 241 to pivot back to the position shown in FIG. 2A under the action of the springs. Also, slots 270, 271 become aligned with the lower pins, although the lower pins are not yet located in slots 270, 271. As a result, accessory unit 200 is now docked to table 100, as shown in FIG. 3B, to form a table and accessory unit assembly. When the height-adjusting mechanism of table 100 is activated, accessory unit 200 is raised along with tabletop 125, as shown in FIG. 3C. During the initial portion of the height adjustment, the lower pins enter slots 270, 271, and the upper pins move to the top of slots 265, 266. Further increases in height therefore result in accessory unit 200 being lifted off of the surface on which accessory unit 200 is supported. Accordingly, the relative positioning of shelves 205, 206 and tabletop 125 is preserved once the upper and lower pins reach the top of slots 265, 266, 270, 271.

Figure 4:
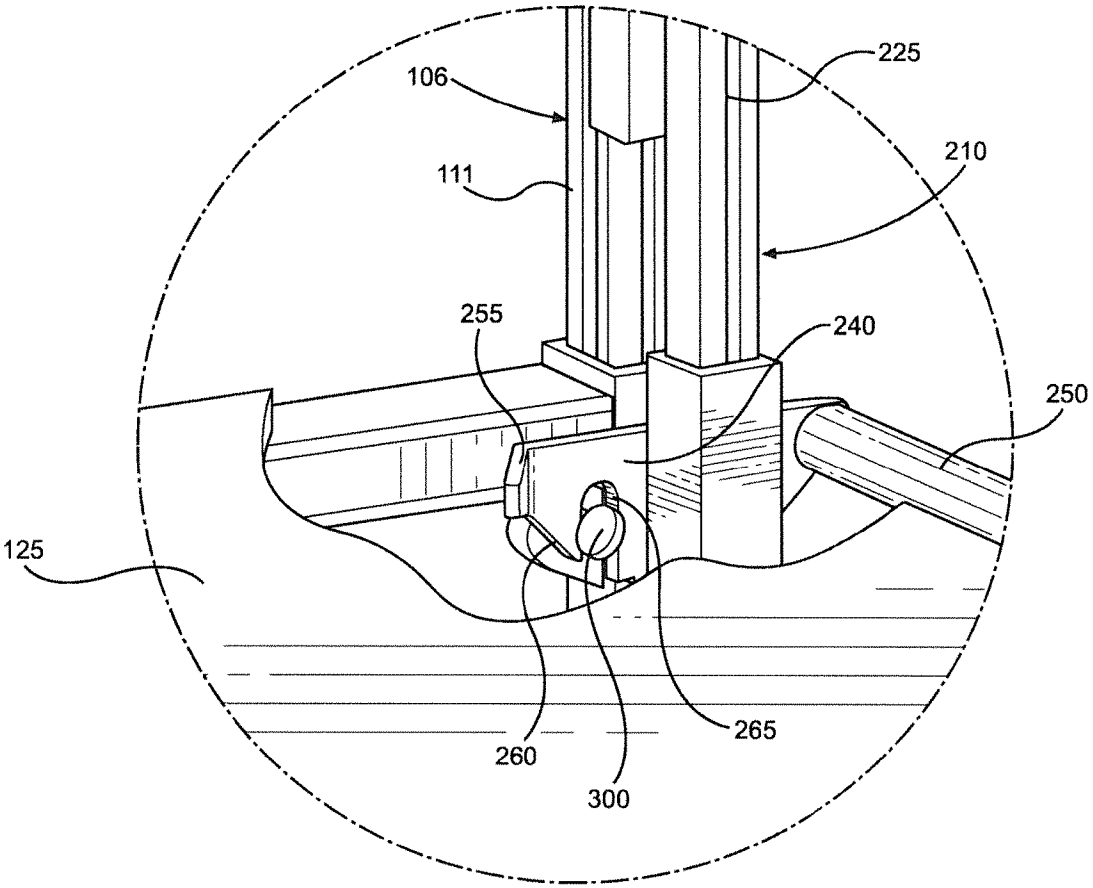
FIG. 4 is an enlarged view of a portion of FIG. 3B.
Figure 5A:
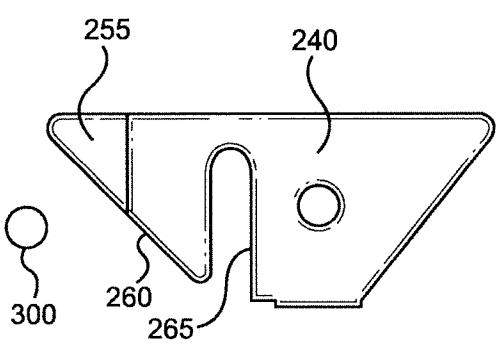
FIG. 5A shows an upper hook and pin of the docking mechanism prior to docking.
Figure 5B:
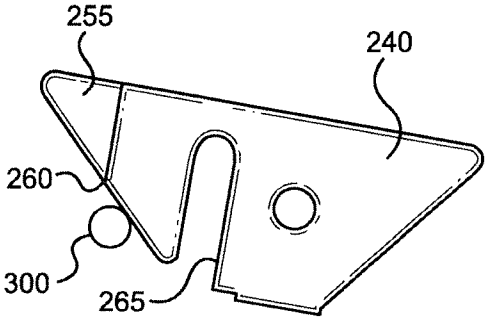
FIG. 5B shows the upper hook and pin during docking.
Figure 5C:
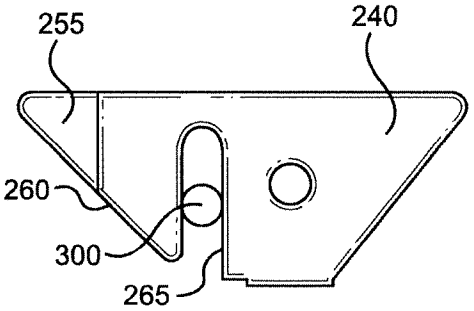
FIG. 5C shows the upper hook and pin after docking.
Figure 6A:
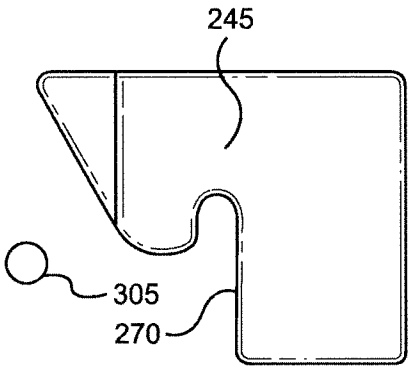
FIG. 6A shows a lower hook and pin of the docking mechanism prior to docking.
Figure 6B:
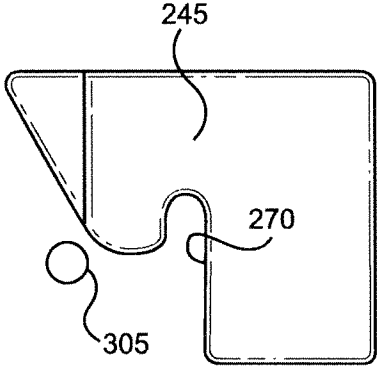
FIG. 6B shows the lower hook and pin during docking.
Figure 6C:
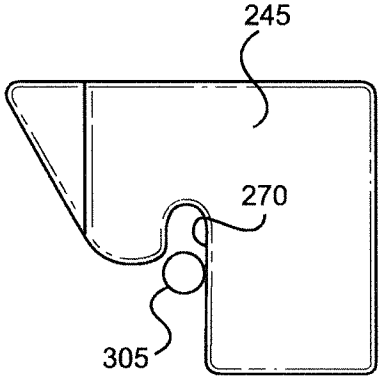
FIG. 6C shows the lower hook and pin after docking.

With reference to FIG. 4, there is shown an enlarged view of a portion of FIG. 3B in which the docking of accessory unit 200 to table 100, via upper latch 240 and upper pin 300, is more clearly visible. In addition, FIGS. 5A-C provide a simplified view of the docking of upper latch 240 to upper pin 300, while FIGS. 6A-6C provide a simplified view of the docking of lower latch 245 to lower pin 305. FIGS. 5A and 6A show latches 240, 245 and pins 300, 305 just prior to docking. In FIG. 5B, upper pin 300 contacts cam surface 260 of latch 240, which forces upper latch 240 upward, and, in FIG. 6B, lower pin 305 begins passing under lower latch 245. Once docking is complete, upper pin 300 is located in slot 265 of upper latch 240, as shown in FIG. 5C, and lower pin 305 is located just below slot 270 of lower latch 245, as shown in FIG. 6C. As described above, during initial height adjustment, pins 300, 305 move upward within slots 265, 270 until pins 300, 305 contact the top of slots 265, 270, and further adjustment then causes accessory unit 200 to be lifted off the surface on which accessory unit 200 is supported. To undock accessory unit 200 from table 100, table 100 is placed in the lowered position of FIG. 3B, and handle 250 is pressed downward to pivot upper latches 240, 241 upward such that the upper pins are no longer located in slots 265, 266. Accessory unit 200 can then be moved away from table 100 to the position of FIG. 3A. When accessory unit 200 is raised by the height-adjusting mechanism of table 100, accessory unit 200 cannot be undocked from table 100 even if handle 250 is pressed downward because pins 300, 305 remain engaged in slots 265, 270. As a result, this arrangement prevents undocking in a manner that would be dangerous to a user.

Based on the above, it should be readily apparent that the present invention provides a height-adjustable table that can be conveniently used with a non-height-adjustable structure. Although described with reference to preferred embodiments, it should be readily understood that various changes or modifications could be made to the invention without departing from the spirit thereof. For example, rather than casters, the table and accessory unit can include feet that contact the surface on which the table and accessory unit are supported. Also, the positioning of the latches and pins can be reversed such that the pins are located on the accessory unit and the latches are located on the table. In general, the invention is only intended to be limited by the scope of the following claims.

The invention claimed is:

1. A table and accessory unit assembly comprising:

a height-adjustable table, which is configured to be supported on a surface and includes:

a tabletop; and a height-adjusting mechanism configured to move the tabletop relative to the surface;

a freestanding accessory unit, which is configured to be supported on the surface; and a docking mechanism configured to couple the freestanding accessory unit to the height-adjustable table, wherein, when the freestanding accessory unit is coupled to the height-adjustable table, the freestanding accessory unit lifts off the surface as the tabletop moves away from the surface.

2. The table and accessory unit assembly of claim 1, wherein a first portion of the docking mechanism is located on the height-adjustable table and a second portion of the docking mechanism is located on the freestanding accessory unit.

3. The table and accessory unit assembly of claim 2, wherein the docking mechanism includes a pin and a latch, the latch contacting the pin when the freestanding accessory unit is coupled to the height-adjustable table.

4. The table and accessory unit assembly of claim 3, wherein:

the pin constitutes an upper pin;

the latch constitutes an upper latch;

the docking mechanism further includes a lower pin and a lower latch; and the lower latch contacts the lower pin when the freestanding accessory unit is moved relative to the surface.

5. The table and accessory unit assembly of claim 4, wherein the upper latch is pivotally coupled to the height-adjustable table or freestanding accessory unit and the lower latch is fixed so as to not pivot relative to the height-adjustable table or freestanding accessory unit.

6. The table and accessory unit assembly of claim 3, wherein the latch includes:

a cam surface configured to contact the pin during coupling of the freestanding accessory unit to the height-adjustable table; and a slot configured to receive the pin when the freestanding accessory unit is coupled to the height-adjustable table.

7. The table and accessory unit of claim 6, wherein the docking mechanism further includes a handle configured to cause the latch to pivot relative to the pin, and wherein pivoting the latch relative to the pin does not cause the pin to exit the slot when the freestanding accessory unit is not supported on the surface.

8. The table and accessory unit of claim 6, wherein the latch further includes an in-turned portion that contacts the height-adjustable table or freestanding accessory unit during coupling of the freestanding accessory unit to the height-adjustable table.

9. The table and accessory unit of claim 1, wherein the freestanding accessory unit includes a leg and a storage structure coupled to the leg.

10. The table and accessory unit of claim 9, wherein the freestanding accessory unit further includes a foot or caster configured to support the freestanding accessory unit on the surface.

11. A table and accessory unit assembly comprising:

a height-adjustable table, which is configured to be supported on a surface, including: a lower unit, an upper unit, and a height-adjusting mechanism configured to move the upper unit relative to the lower unit;

a freestanding accessory unit, which is configured to be supported on a surface; and a docking mechanism configured to couple the freestanding accessory unit to the height-adjustable table, wherein, when the freestanding accessory unit is coupled to the height-adjustable table, the freestanding accessory unit is raised away from the lower unit and lifts off the surface as the upper unit is raised away from the lower unit.

12. The table and accessory unit assembly of claim 11, wherein a first portion of the docking mechanism is located on the height-adjustable table and a second portion of the docking mechanism is located on the freestanding accessory unit.

13. A method of docking a height-adjustable table and a freestanding accessory unit with a docking mechanism, the height-adjustable table supported on a surface and including a tabletop and a height-adjusting mechanism configured to move the tabletop relative to the surface, the freestanding accessory unit supported on the surface and the docking mechanism configured to couple the freestanding accessory unit to the height-adjustable table, the method comprising:

coupling the height-adjustable table and freestanding accessory unit with the docking mechanism; and moving the tabletop and freestanding accessory unit away from the surface with the height-adjusting mechanism whereby the accessory unit lifts off the surface as the tabletop moves away from the surface.

14. The method of claim 13, wherein coupling the height-adjustable table and freestanding accessory unit includes coupling a first portion of the docking mechanism located on the height-adjustable table with a second portion of the docking mechanism located on the freestanding accessory unit.

15. The method of claim 14, wherein the docking mechanism includes a pin and a latch, and coupling the height-adjustable table and freestanding accessory unit causes the pin to come in contact with the latch.

16. The method of claim 15, wherein the pin constitutes an upper pin, the latch constitutes an upper latch, the docking mechanism further includes a lower pin and a lower latch, and moving the tabletop and freestanding accessory relative to the surface causes the lower pin to come in contact with the lower latch.

17. The method of claim 16, wherein the lower latch is fixed so as to not pivot relative to the height-adjustable table or freestanding accessory unit, and coupling the height-adjustable table and freestanding accessory unit includes pivoting the upper latch relative to the height-adjustable table or freestanding accessory unit.

18. The method of claim 15, wherein the latch includes a cam surface and a slot, and coupling the height-adjustable table and freestanding accessory unit causes the pin to come in contact with the cam surface and receive the pin in the slot.

19. The method of claim 18, wherein the docking mechanism further includes a handle, and the method further comprises uncoupling the height-adjustable table and freestanding accessory unit by pivoting the latch relative to the pin with the handle while the freestanding accessory unit is supported on the surface.

20. The method of claim 18, wherein the latch further includes an in-turned portion, and coupling the height-adjustable table and freestanding accessory unit includes contacting the height-adjustable table or freestanding accessory unit with the in-turned portion.

21. The table and accessory unit assembly of claim 3 wherein the latch is rigid.

* * * * *